US005337526A

United States Patent [19]

Hartman

[11] Patent Number: 5,337,526

[45] Date of Patent: Aug. 16, 1994

[54] STEP FLASHING STRIP

[76] Inventor: Lewis C. Hartman, 4867 Granger Rd., Akron, Ohio 44333

[21] Appl. No.: 955,290

[22] Filed: Oct. 1, 1992

[51] Int. Cl.[5] ..... E04D 1/36

[52] U.S. Cl. ..... 52/58; 52/518; 52/60

[58] Field of Search ..... 52/58, 518, 60

[56] References Cited

U.S. PATENT DOCUMENTS 4,666,785 5/1987 Crepeau ..... 52/58
4,700,512 10/1987 Laska ..... 52/58
4,951,431 8/1990 Sweers ..... 52/58

*Primary Examiner*—Carl D. Friedman
*Assistant Examiner*—Christopher Todd Kent
*Attorney, Agent, or Firm*—Hudak & Shunk Co.

[57] ABSTRACT

A step flashing strip having a plurality of flashing segments, secured to another segment in spaced overlapping relationship by a spacer to allow for the insertion of a shingle into the overlapping region between the segments, allows for a simplified, time saving method of providing a water shedding termination of an imbricating roof at its intersection with another surface.

17 Claims, 3 Drawing Sheets

STEP FLASHING STRIP

FIELD OF THE INVENTION

The invention relates to a preassembled step flashing strip for an imbricating roof.

BACKGROUND OF THE INVENTION

An imbricating roof of a structure meets a vertical surface, such as an off-set second story, chimney, skylight or roof elevation change, tile termination of each course of shingle commonly is an individual piece of metal (copper, galvanized steel or aluminum, for example) bent at or near a 90° angle. These pieces are combined with the individual shingle in such a way as to create an overlap intended to shed water. Such conventional step flashing offers a continual overlapping of individual pieces of material to form a water resistant termination of the shingle courses. Step flashing heretofore has been the most effective means for the termination of an imbricating roof system.

SUMMARY OF THE INVENTION

The tedious, labor intensive termination of shingle courses as described above can be improved with the step flashing strips of the present invention which comprises a plurality of flashing segments each having a pair of intersecting planar legs formed from or as a single piece, and a plurality of spacers which secure each flashing segment to an adjacent segment in spaced, partially overlapping relationship to allow for the insertion of a shingle between the overlapping region of adjacent segments.

In accordance with the present invention, after the first course of shingles come in contact with a vertical surface, the pre-manufactured strip of step flashing is laid down in the right angle corner. The shingles are then placed in the appropriate slots of the pre-manufactured strip and nailed in place.

The pre-manufactured strip or step flashing of the present invention (1) saves the installer time by reducing the handling of single pieces of material, (2) saves the installer time and material by reducing the number of fasteners needed to attach the strip flashing, and (3) as a result of reducing the number of fasteners used, fewer penetrations will occur in the roof, further reducing the possibility of leak(s) occurring.

A common mistake made with single step metal flashing is the use of different metal components such as an aluminum step flashing and galvanized roofing nail fasteners. With this mating of dissimilar metals, a galvanic action could occur corroding the aluminum and causing leak(s). As mentioned above, the reduction of fasteners needed when using the strip step flashing of the present invention reduces this application problem if galvanic action occurs.

This invention increases an installer's productivity and reduces labor costs in the application of step flashing with said surfaces by reducing handling, positioning and fastening.

An equally important advantage is the installer can use the strip step flashing as a guide for the chalk line that keeps succeeding shingle course parallel. Where the strip step flashing of the present invention is applied, the labor to measure and mark the roof deck for the parallel lines would be eliminated.

A further advantage is the reduction of possible errors made when the individual step flashings are installed, such as misplaced fasteners. Fasteners must be placed within about two inches from the top of each step flashing or the fasteners will be exposed to the weather and possibly resulting in failure.

The present invention would reduce the fasteners by as much as about 70 percent thereby reducing the potential for leakage.

An additional advantage is that the strip step flashing of the present invention can be manufactured to accommodate varying thicknesses of shingles as well as custom thickness of shingles for any imbricating roofing system.

The strip step flashing of the present invention can replace the standard metal seep flashing application technique without changing the established accepted appearance of the finished installation.

DETAILED DESCRIPTION OF THE DRAWINGS

DETAILED DESCRIPTION OF THE INVENTION

Figure 1:
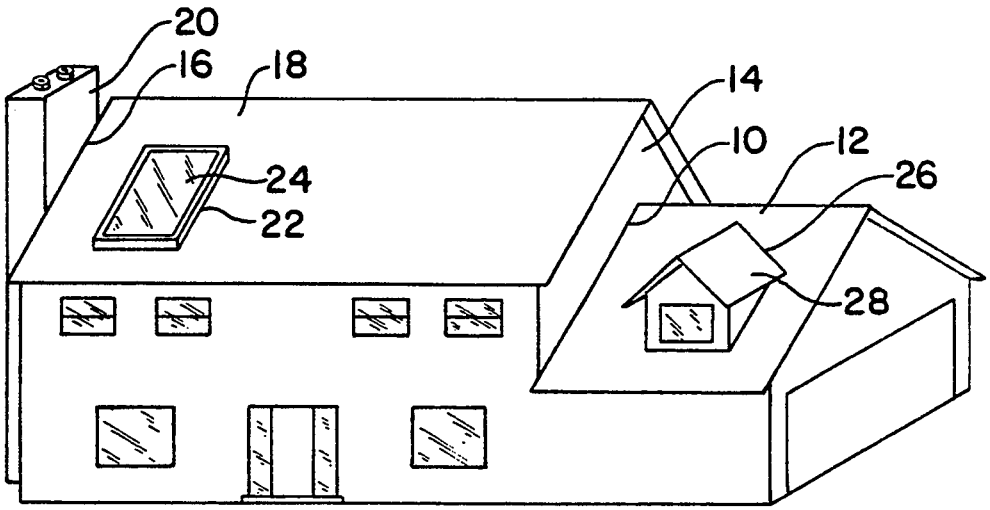
FIG. 1 is a perspective view of a structure showing typical application points for the step flashing strip of the present invention.

Typical applications of the step flashing strip of the invention generally include any edge formed by the intersection of an imbricating roof and another planar surface. Examples, shown in FIG. 1, include the intersection 10 of an imbricating roof 12 with a vertical wall 14, the intersection 16 of an imbricating roof 18 with a chimney 20, the intersection 22 of the roof 16 with a skylight 24, and a roof valley formed by intersecting imbricating roof faces such as the valley 26 formed by the imbricating roof faces 12 and 28.

Figure 2:
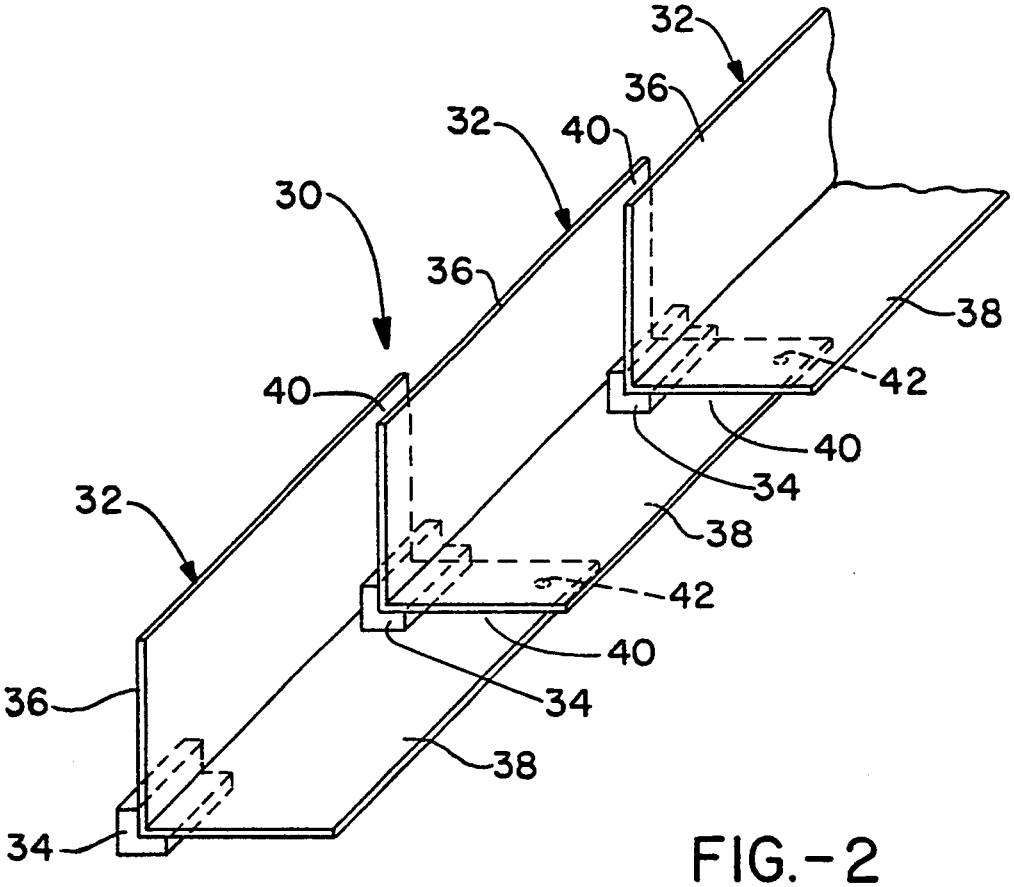
FIGS. 2 and 2A are perspective views of step flashing strips embodying the present invention.
Figure 3:
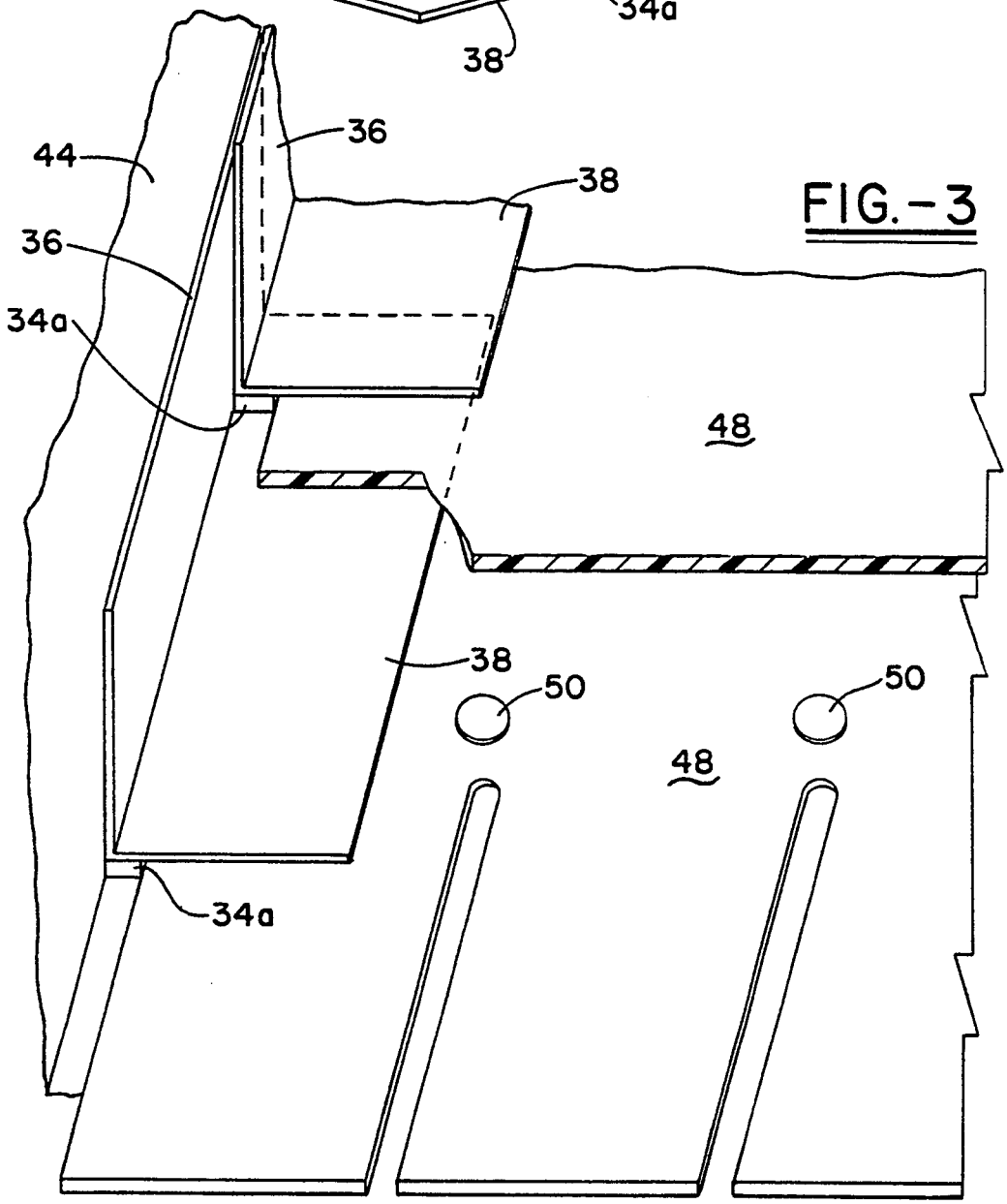
FIG. 3 is a perspective view of a particular application showing the strip step flashing of FIG. 2 with a shingle in place.
Figure 4:
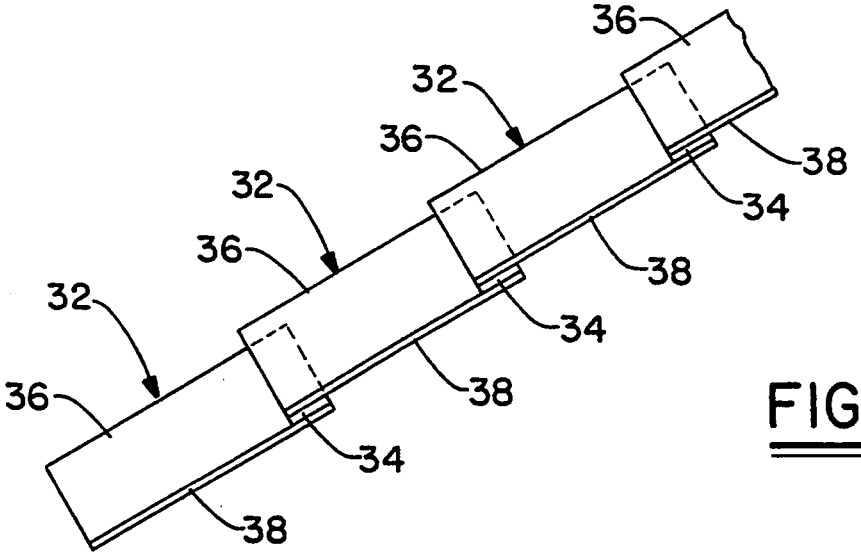
FIG. 4 is a side elevation view of the strip step flashing of FIG. 2.

With reference to FIGS. 2 and 3, the step flashing strip 30 comprises a plurality of flashing segments 32 which are preferably secured one to another in spaced, partially overlapping relationship by a plurality of spacers 34. Each flashing segment 32 is formed from, or as, a single piece and has a pair of intersecting planar, preferably rectangular shaped, legs 36 and 38. The legs 36 and 38 are formed at, or bent to form, a predetermined custom or standard bend to provide an angle, such as 90° , between the legs. The segments which for any particular strip are substantially identical, are secured to one another in spaced partially overlapping to form two overlapping areas at each juncture between adjacent flashing segments. A first of the overlapping areas at each juncture is defined by the overlapping areas of legs 36 of adjacent segments 32. The second of the overlapping means at each juncture is defined by the overlapping areas of legs 38 of adjacent segments 32 relationship.

Figure 2A:
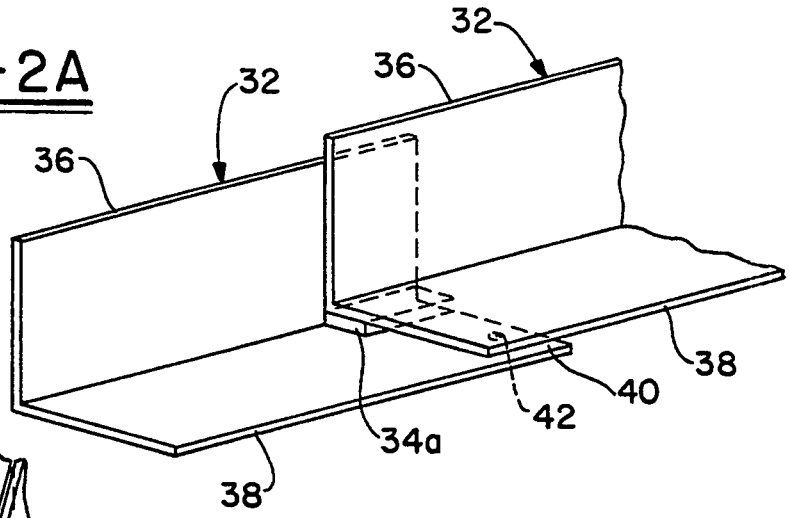

Spacers 34 act to secure adjacent segments 32 to each other in partially overlapping relationship to form an integrated or continuous, one-piece step flashing strip 30, and the spacers 34 also provide a gap or space 40 at the overlapping areas between adjacent segments 32 into which a shingle can be snugly inserted. A spacer 34 is situated such that it resides within at least one of the overlapping areas of each juncture between adjacent segments 32. The spacer 34 is situated contiguous with the intersection of legs 36 and 38 of at least one of the joined segments 32 such that it occupies substantially less than all of any overlapping area at which it resides to permit placement of a shingle between one or both of the overlapping areas between legs 36 and legs 38 of adjacent flashing segments 32. The spacers 34 can be designed to provide a space 40 for shingle insertion between either or both of the legs 36 and 38 of adjacent flashing segments 32 as shown in FIG. 2. The strip shown in FIG. 2 having spaces between adjacent legs 36 and 38 can be used, for example, at the valley 26 between two imbricating roof faces to allow for insertion of course terminal shingles on each side of the flashing. The strip shown in FIG. 2A having spaces only between adjacent legs 38 can be used, for example, between intersections 10, 16 and 22, wherein an imbricating roof face intersects with a nonroof surface such as a vertical wall, a skylight or a chimney. The spacers 34 can, for example, as shown in FIG. 2, be L-shaped strips which are of a length substantially equal to the length of the overlapping region of the legs 36 and 38 of adjacent flashing segments 32. Alternatively, the spacers 34*a* can, for example, as shown in FIG. 2A, be strips having a rectangular cross section with a length substantially equal to the length of the overlapping region of the legs 36 and 38 of adjacent flashing segments 32. However, generally any means, both for spacing the legs 36 and 38 of adjacent segments 32 to allow for shingle insertion, and for facilitating securement of adjacent segments 32 to provide a continuous, integrated or one-piece step flashing strip comprising a plurality of flashing segments, may be used.

The spacers 34 are preferably from about ⅛ inch to about 3/16 inch thick but in some cases may advantageously range from about 1/32 inch to about 2 inches in thickness depending on the thickness of the shingles to be used. The flashing segments 32 are preferably about 4 inches wide by about 7 inches long, but in some cases may advantageously range from about 1 inch to about 3 inches wide by about 1 inch to about 5 feet long. The thickness of the flashing segments 32 can range from about 2 mils to about 400 mils and is preferably from about 30 mils to about 200 mils. The overlap of the individual pieces is preferably from 2 inches to 19 inches but in some cases may advantageously range from ¼ inch to 5 feet. The spacers 34 allow for the insertion of a shingle without deforming the legs 36 and 38 of flashing segments 32.

The strip 30 can have any desired number of segments 32 depending on the length of each segment, the amount of overlap between segments and the desired length of the strip. It is contemplated that the length of the step flashing strips will desirably range from about 4 feet to 12 feet.

A fastener opening 42 is preferably provided at the overlapped leg area of selected segments 32 or at each segment to rapidly facilitate proper placement of fasteners such as on screws or nails, and to eliminate or at least substantially reduce the possibility of splitting of the flashing segment 32 upon fastening the strip 30 to a roof.

Materials suitable for fabricating the flashing segments 32 and spacers 34 include metals such as aluminum, galvanized steel and copper; elastomers such as chlorosulfonated polyethylene (CSPE), ethylene propylene diene monomer (EPDM), chlorinated polyethylene (CPE), butyl rubber, styrene butadiene rubber (SBR), nitrile rubber, and the like; thermoplastics such as polyvinyl chloride (PVC) post chlorinated polyvinyl chloride (CPVC), acrylonitrile-butadiene-styrene resin (ABS), polyolefins such as polypropylene or polyethylene, acrylic polymers, and the like; and bitumens such as asphaltic compounds, rubberized aspbaltic compounds and coal-tar compounds. The spacers 34 can be of similar material to that of the flashing segments or dissimilar material.

The step flashing strips of the invention can be fabricated by forming the flashing segments 32 and spacers 34 together such as by casting, extruding, or by molding thermoplastic, thermosetting or metal materials. An extruded strip having angled legs and integrally formed spacers can be cut into appropriate lengths to form flashing segments 32 with integrally formed spacers, and then secured one to another. More preferably, the flashing segments 32 and spacers 34 can be formed by cutting a strip of material having the appropriate cross section into individual spacers 34 of appropriate length and separately forming the flashing segments as by molding or by cutting and bending sheet materials or by cutting an appropriately shaped extruded material into the individual segments 32. The spacers 34 and segments 32 are then joined to one another by various conventional means, depending upon the materials used, such as by adhesives, fusion or welding, to form the step flashing strips of the invention.

The strip step flashing 30 shown in FIG. 3 is ensconced at the junction of a vertical surface 44 and sloped roof. The spacer 34 allows the insertion of the shingle 48 into the strip step flashing without deforming the legs 38 of the individual step flashing segments. The fasteners 50 are typically placed over the cutout of the shingle in accordance with conventional practice. The strip 30 can be secured to the roof with fewer fasteners than conventional practice wherein a fastener is required for each flashing piece at the end of a shingle course. For example, it would be possible to use a fastener at every third or forth segment by lifting the corner of leg 38 and attaching a fastener through opening 42.

Figure 5:
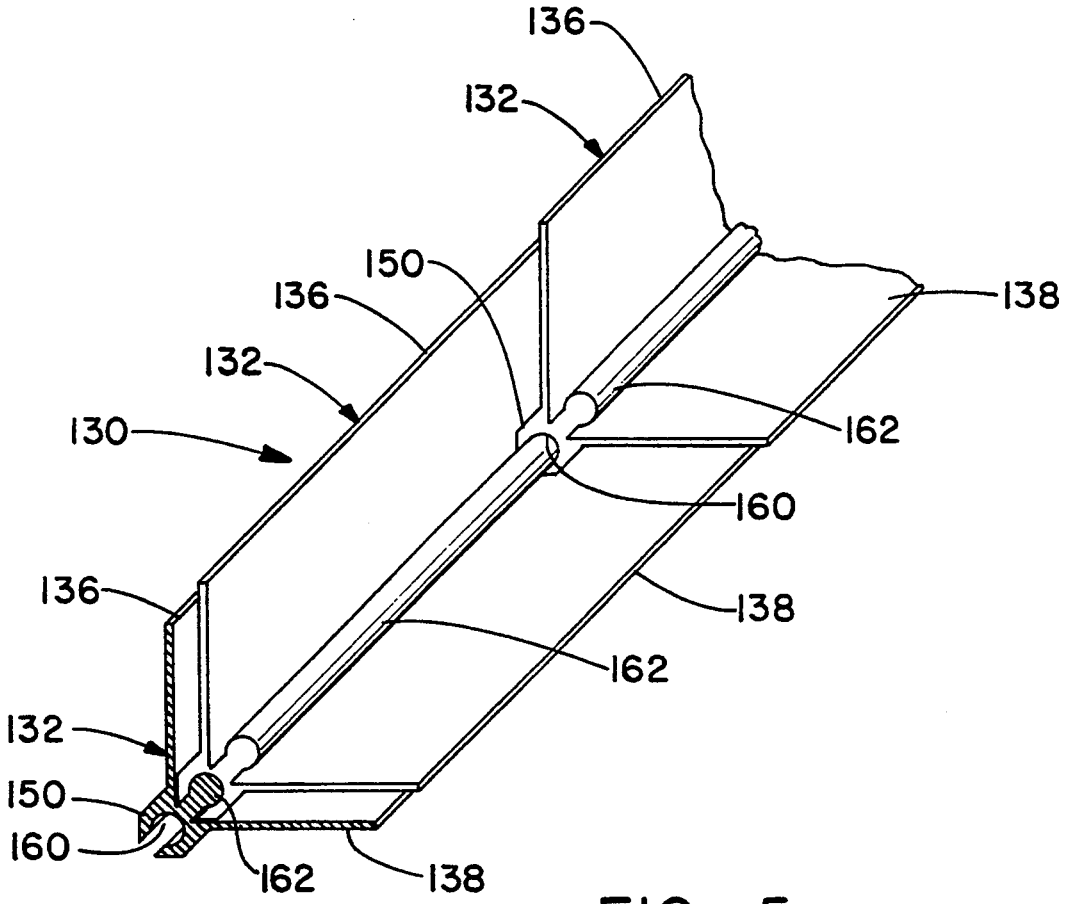
FIG. 5 is a perspective view of an alternative embodiment of a step flashing strip formed by interlocking a plurality of extruded step flashing segments.

In an alternative embodiment, the individual segments 132 can be continuously extruded with cooperating, integrally formed interlocking spacer means 150 for attaching one segment to another to form a strip 130 as shown in FIG. 5 and for providing space between overlapping legs 132 and/or legs 136 of adjacent segments 132 of strip 130. Flashing segment 132 having legs 136 and 138 is generally similar to flashing segment 32 but has an interlocking spacer integrally formed with a keyshaped slot 160 and a cooperating key-shaped projection 162 which securely fits into the slot 160 of an adjacent segment 132 to form a strip 130 as shown in FIG. 5. The particular embodiment shown in FIG. 5 is only intended as illustrative of the concept of means for interlocking flashing segments in spaced, partially overlapping relationship to one another to allow for insertion of a shingle between each pair of adjacent segments. Various alternative means will be readily apparent to those skilled in the pertinent art, and accordingly are within the spirit and scope of the invention.

While in accordance with the Patent Statutes, the best mode and preferred embodiment has been set forth, the scope of the invention is not limited thereto, but rather by the scope of the attached claims.

What is claimed is:

1. A step flashing strip comprising a plurality of flashing segments and a plurality of spacers, each of said flashing segments having a pair of intersecting planar legs, the planar legs of each of said flashing segments partially overlapping the legs of an adjacent flashing segment, said partially overlapping legs of adjacent flashing segments, defining a pair of overlapping areas having opposing surfaces, each of said spacers residing between at least a portion of at least one of said pair of overlapping areas defined by said opposing surfaces of said adjacent flashing segments, each of said spacers being fused or joined by an adhesive to both of said opposing surfaces throughout substantially all of said portion of said overlapping area at which said spacer resides, each spacer providing a gap for insertion of a shingle into at least one of said pair of overlapping areas of adjacent flashing segments.

2. A step flashing strip in accordance with claim 1, wherein the legs are each substantially rectangular.

3. A step flashing strip in accordance with claim 2, wherein the legs are formed, or bent to intersect at a predetermined angle.

4. A step flashing strip in accordance with claim 1, wherein a gap for shingle insertion is provided at only one of said overlapping areas and wherein the legs at the other of said overlapping areas are in abutment.

5. A step flashing strip in accordance with claim 1, wherein a gap for shingle insertion is provided at both of said overlapping areas.

6. A step flashing strip in accordance with claim 5, wherein each spacer is a strip having an L-shaped cross section.

7. A step flashing in accordance with claim 3, wherein an opening is provided at the overlapping area of at least one of the flashing segments to indicate and allow proper placement and passage of a fastener therethrough for fastening of the strip to a roof.

8. A step flashing strip in accordance with claim 3, wherein the flashing segments are formed of a metal selected from the group consisting of aluminum, galvanized steel and copper.

9. A step flashing strip in accordance with claim 3, wherein the flashing segments are formed of an elastomeric material selected from the group consisting of chlorosulfonated polyethylene, ethylene propylene diene monomer, chlorinated polyethylene butyl rubber, styrene butadiene rubber and nitrile rubber.

10. A step flashing strip in accordance with claim 3, wherein the flashing segments are formed of a thermoplastic material selected from the group consisting of polyvinyl chloride, chlorinated polyvinyl chloride, acrylonitrile-butadiene-styrene, polyolefins and acrylic polymers.

11. A step flashing strip in accordance with claim 4, wherein the flashing segments are formed of a bituminous material selected from the group consisting of asphaltic compounds, rubberized asphaltic compounds and coal-tar compounds.

12. A step flashing strip in accordance with claim 3, wherein the spacers are formed of a metal selected from the group consisting of aluminum, galvanized steel and copper.

13. A step flashing strip in accordance with claim 3, wherein the spacers are formed of an elastomeric material selected from the group consisting of chlorosulfonated polyethylene, ethylene propylene diene monomer, chlorinated polyethylene, butyl rubber, styrene butadiene rubber and nitrile rubber.

14. A step flashing strip in accordance with claim 3, wherein the spacers are formed of a thermoplastic material selected from the group consisting of polyvinyl chloride, chlorinated polyvinyl chloride, acrylonitrile-butadiene-styrene, polyolefins and acrylic polymers.

15. A step flashing strip in accordance with claim 3, wherein the spacers are formed of a bituminous material selected from the group consisting of asphaltic compounds, rubberized asphaltic compounds and coal-tar compounds.

16. A step flashing strip comprising a plurality of flashing segments and a plurality of spacers, each of said flashing segments having a pair of intersecting planar legs, the planar legs of each of said flashing segments partially overlapping the legs of an adjacent flashing segment, adjacent flashing segments being joined to each other by one of said spacers disposed between said partially overlapping legs of adjacent flashing segments, each spacer providing a gap for shingle insertion into only one of said overlapping areas, the legs at the other of said overlapping areas being in abutment.

17. A step flashing strip comprising a plurality of flashing segments and a plurality of spacers, each of said flashing segments having a pair of intersecting planar legs, the planar legs of each of said flashing segment partially overlapping the legs of an adjacent flashing segment, adjacent flashing segments being joined to each other by one of said spacers disposed between said partially overlapping legs of adjacent flashing segments, each spacer providing a gap for shingle insertion into both of said overlapping areas.

* * * * *